US007832804B2

(12) United States Patent
LaFreniere

(10) Patent No.: US 7,832,804 B2
(45) Date of Patent: Nov. 16, 2010

(54) LOUNGE CHAIR WITH ADJUSTABLE ARM RESTS

(76) Inventor: Sandi LaFreniere, P.O. Box 407, Rock Hill, CT (US) 06067

( * ) Notice: Subject to any disclaimer, the term of this patent is extended or adjusted under 35 U.S.C. 154(b) by 21 days.

(21) Appl. No.: 12/105,084

(22) Filed: Apr. 17, 2008

(65) Prior Publication Data

US 2008/0203802 A1 Aug. 28, 2008

Related U.S. Application Data

(63) Continuation-in-part of application No. 10/963,938, filed on Oct. 12, 2004.

(51) Int. Cl.
*B60N 2/46* (2006.01)
*A47C 7/50* (2006.01)

(52) U.S. Cl. ..... 297/411.32; 297/900; 297/31; 297/36

(58) Field of Classification Search ..... 297/31, 297/40, 900, 284.9, 411.23, 411.35, 411.36; D6/362, 611, 382, 353, 334
See application file for complete search history.

(56) References Cited

U.S. PATENT DOCUMENTS 585,913 A * 7/1897 Haynes ..... 297/411.32
3,063,752 A 11/1962 Moore
3,550,958 A * 12/1970 Krein ..... 297/411.32
3,807,799 A * 4/1974 Freedman ..... 297/411.32
4,017,118 A 4/1977 Cawley
4,252,371 A * 2/1981 Lehnen ..... 297/411.4
4,441,756 A 4/1984 Liou et al.
4,537,444 A * 8/1985 Maruyama et al. ..... 297/284.9
4,632,455 A 12/1986 Schiller et al.
4,810,035 A * 3/1989 Takahashi ..... 297/464
4,917,395 A 4/1990 Gabriele
4,938,534 A 7/1990 Tornero
5,060,967 A 10/1991 Hulterstrum
5,156,226 A 10/1992 Boyer et al.
5,195,803 A 3/1993 Quintile
5,246,265 A * 9/1993 Nagan et al. ..... 297/54
5,290,092 A 3/1994 Geer
5,297,021 A 3/1994 Koerlin et al.
5,297,850 A * 3/1994 Guleserian ..... 297/377
5,333,887 A 8/1994 Luther
5,348,367 A * 9/1994 Mizelle ..... 297/83
5,364,166 A 11/1994 Zegeer
5,370,446 A 12/1994 Bancod
5,437,609 A 8/1995 Leonard et al.
5,466,039 A 11/1995 Umbrianna (Continued)

*Primary Examiner*—David Dunn
*Assistant Examiner*—Erika Garrett
(74) *Attorney, Agent, or Firm*—Marger Johnson & McCollom, P.C.

(57) ABSTRACT

According to some embodiments of the invention, the convenience of lounge, pool, and patio furniture is increased by providing adjustable armrests that do not require cumbersome adjustments in order to reposition the armrest. According to some embodiments of the invention, an additional pair of armrests may be attached to existing conventional chair designs that have only one pair of armrests in order to increase the utility of the chair, which may be especially useful for lounge chairs, patio furniture, chaise lounges, and the like. According to other embodiments of the invention a lounge chair includes armrests that rotate toward and away from a person sitting in the chair, armrests that remain horizontal as the chair is repositioned, and platforms to support the arms of a person lying in the chair.

16 Claims, 5 Drawing Sheets

U.S. PATENT DOCUMENTS 5,681,083 A * 10/1997 Nelson et al. ..... 297/284.1
5,775,708 A 7/1998 Heath
5,865,412 A 2/1999 Mason
5,882,083 A * 3/1999 Robinson ..... 297/440.2
5,967,610 A 10/1999 Lin
6,032,976 A 3/2000 Dickie et al.
6,045,183 A 4/2000 Weber
6,059,365 A * 5/2000 Diamond ..... 297/354.13
6,109,685 A 8/2000 Lindsey et al.
6,142,350 A 11/2000 Alexander
6,217,119 B1 4/2001 Cook et al.
6,238,002 B1 5/2001 Brewer et al.
6,343,805 B1 2/2002 Roy
6,375,265 B1 4/2002 Hubner et al.
6,431,650 B1 8/2002 Visone
6,467,847 B2 10/2002 Bidare
6,508,513 B1 1/2003 Hall et al.
6,520,587 B2 2/2003 Noiseux
6,533,358 B1 3/2003 Avihod
6,539,558 B2 4/2003 Shero
6,604,750 B2 8/2003 Malassigne et al.
6,659,553 B2 12/2003 Achleitner et al.
6,722,689 B2 4/2004 Kreamer
6,793,288 B2 9/2004 Rutty
6,913,318 B2 7/2005 Higley et al.

* cited by examiner

LOUNGE CHAIR WITH ADJUSTABLE ARM RESTS

CROSS REFERENCE TO RELATED APPLICATIONS

This application is a Continuation-in-Part of U.S. patent application Ser. No. 10/963,938, entitled LOUNGE CHAIR WITH ADJUSTABLE ARM RESTS, filed Oct. 12, 2004, the disclosure of which is herein incorporated by reference in its entirety.

BACKGROUND OF THE INVENTION

1. Technical Field of the Invention

This disclosure relates generally to pool, patio, and beach furniture, and more particularly, to a lounge chair having improved arm supporting features.

2. Description of the Related Art

FIGS. 1A, 1B, 2A, 2B, and 3 are diagrams illustrating an arm rest for chairs, chaise lounges, and the like as described in U.S. Pat. No. 5,364,166 issued Nov. 15, 1994 to Peggy Zegeer ("Zegeer"). FIGS. 1A and 1B are side and front elevational diagrams, respectively, illustrating a conventional chaise lounge with a back support and an arm rest in a first position. FIGS. 2A and 2B are side and front elevational diagrams, respectively, illustrating the conventional chaise lounge with the back support and the arm rest in a second position. FIG. 3 is a side diagram illustrating the conventional chaise lounge with the back support and the arm rest in a third position.

Referring to FIGS. 1A, 1B, 2A, 2B, and 3, a conventional chaise lounge 100 includes a U-shaped adjustable back support 110, a seat support 120, a U-shaped adjustable foot/leg support 130, and two arm rests 140. The back support 120 and the foot/leg support 130 are adjustable because they attach to the seat support 120 at the pivots 150. Through a familiar adjustment process, the pivots 150 may be used to position the back support 120 and the foot/leg support 130 at different angles relative to the seat support 120.

Two U-shaped leg supports 122 are attached to the seat support 120, and are pivotable with respect to the seat support 120. The leg supports 122 engage the surface (i.e., the patio, the deck, the beach, the pool apron, the ground) beneath the seat support 120, providing support for the entire chaise lounge 100. Body support material 160 extends vertically down the center of the chaise lounge 100, the support material 160 attached to the portions of the back support 110, seat support 120, and foot/leg support 130 that are approximately parallel to the underlying support surface.

The back support 110 includes a right side 110R and a left side 110L. Each arm rest 140 is attached to a corresponding one of the right side 110R and the left side 110L of the back support 110 by a securement device 142. Furthermore, each arm rest 140 includes a vertical brace 144.

In order to vertically adjust the position of the arm rest 140, the securement device 142 may be loosened to release its grip from the back support 110. The securement device 142, along with the attached arm rest 140, may then be moved to a different vertical position on the back support 110. For example, referring to FIG. 1A, the position A of the securement device 142 may be adjusted along the line CD, where the line CD runs longitudinally through the center of the securement device 142. Once the securement device 142 and arm rest 140 are in the desired position, the securement device 142 is tightened to maintain its new position on the back support 110.

The position of the armrests 140 may also be adjusted in two angular directions. Referring to FIG. 1A, an angle Φ may be defined as the angle that the line AB makes with respect to the vertical plane that contains the line CD (In FIG. 1A, this is the plane of the paper). The line AB runs longitudinally through the armrest 140. For example, in FIGS. 1A and 1B the angle Φ is zero degrees and in FIGS. 2A and 2B the angle Φ is ninety degrees.

Following the same procedure that was described above for a vertical adjustment of the arm rest 140, the angle Φ may be adjusted. That is, the securement device 142 may be loosened to release its grip from the back support 110. The securement device 142, along with the attached arm rest 140, may then be rotated about the line CD to the desired position and retightened to maintain the desire position.

Referring to FIG. 1A, the angle θ may be defined as the angle between the line CD and the line AB that runs longitudinally through the armrest 140. For example, FIGS. 1A, 2A, and 3 illustrate a series of positions for the chaise lounge 100 where the angle θ becomes increasingly larger. The angle θ may be adjusted by manipulating a lever (not shown) that forces a plate having starburst indentations to disengage from a matching plate whose facing surfaces interface with the starburst indentations. The disengagement allows the armrest 140 to rotate in the θ direction. Once the desired position is reached, the lever is released to allow the plate and matching plate to re-engage.

In this conventional chaise lounge/arm rest system, the vertical brace 144 must always be deployed to support the end of the arm rest 140. As shown in FIGS. 1A and 1B, when the arm rest 140 extends in a direction normal to the plane of the back support 110 (Φ=0), the vertical brace 144 engages the top of the seat support 120. As shown in FIGS. 2A and 2B, when the arm rest 140 is positioned in a direction parallel to the plane of the back support 110 (Φ=90), the vertical brace 144 engages the surface that is supporting the chaise lounge 100.

The vertical brace 144 has a telescoping adjustment so that regardless of the (θ, Φ) position of the arm rest 140 the end of the arm rest is always supported by the vertical brace 144 that is in contact with either the chaise lounge 100 or the surface that supports the chaise lounge 100.

Consequently, with Zegeer's chaise lounge 100, each time that it becomes desirable or necessary to reposition any one of the armrests 140, up to three separate manual adjustments must be made to the armrest 140 or to the securing device 142. For example, if a change in the angular position Φ or a change in the vertical position along the back support 110 is desired, the securing device 142 must be loosened, repositioned in the desired location, and tightened. If a change in the angular position θ is desired, the mechanism on the securing device 142 that provides for this movement must be loosened, the armrest 140 repositioned, and the mechanism tightened. Any time that the vertical position of the armrest 140 is changed, and in some cases when the angular position Φ of the armrest is changed, the telescoping adjustment of the vertical brace 144 must be loosened, adjusted for length, and tightened.

Sunbathers are concerned about obtaining uniform exposure to the sun's rays. While this is obtainable with the chaise lounge 100 described above, in practice this would prove inconvenient, since as the sun moves across the sky continuous adjustment of the armrests 140 may be required to prevent the armrests and/or the sunbather's arms from casting shadows on the sunbather. Sunbathers will also frequently change position to alternately expose the dorsal and ventral portions of their bodies. Furthermore, any person who uses the chaise lounge 100 can be expected to frequently change their sitting/reclining/lounging position to find the optimal comfort setting.

Thus, it is desirable to quickly and easily reposition the armrests to provide support to the arms if the position of a person's body on the chaise lounge 100 is changed. Performing up to six manually intensive adjustments each time a shift in the position of the arm rests 140 is desired may be inconvenient.

Furthermore, because the right side 10R and the left side 10L of the back support 110 must remain clear of obstructions in order for the securing device 142 to be vertically adjustable along the right and left sides of the back support, the body supporting material 160 will have an increased tendency to stretch and sag between the back support because it is only attached to the portions of the back support that are parallel to the ground. More effective support could be provided if the body supporting material 160 was also attached to the right side 110R and left side 110L of the back support 110.

Embodiments of the invention address these and other disadvantages of the conventional art described above.

DETAILED DESCRIPTION OF THE INVENTION

According to embodiments of the invention, a lounge chair that includes two sets of arms provides increased convenience to persons who use the lounge chair. The first set of arms is primarily used when the person's dorsal side is in contact with the lounge chair. The second set of arms is primarily used when the person's ventral side is in contact with the lounge chair. However, it will be recognized that either set of arms may be used in either situation, depending on the tastes and desires of the person using the lounge chair.

Figure 1A:
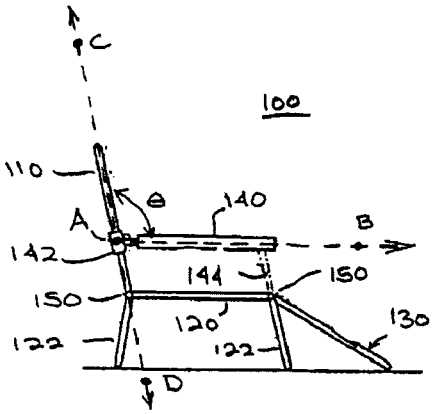
Fig 1A (prior art)
FIGS. 1A and 1B are side and front elevational diagrams, respectively, illustrating a conventional chaise lounge arranged in a first position.
Figure 1B:
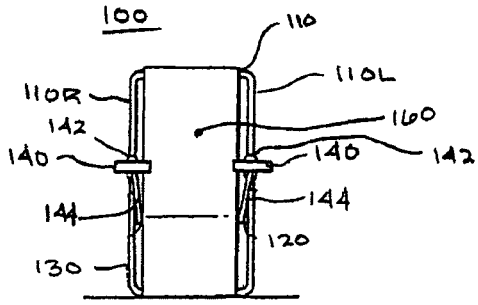
Fig. 1B (prior art)
Figure 2B:
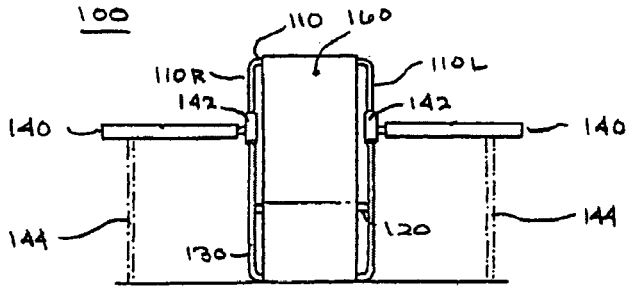
Fig 2B (prior art)
FIGS. 2A and 2B are side and front elevational diagrams, respectively, illustrating the conventional chaise lounge arranged in a second position.
Figure 2A:
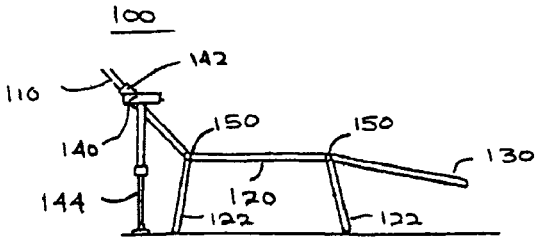
Fig 2A (prior art)
Figure 3:
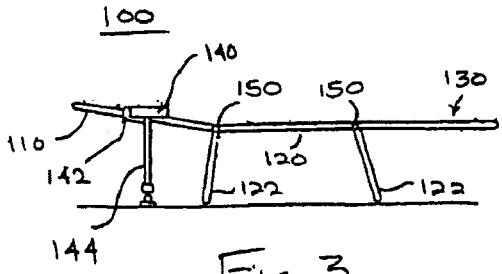
Fig 3 (prior art)
FIG. 3 is a side diagram illustrating the conventional chaise lounge arranged in a third position.
Figure 4:
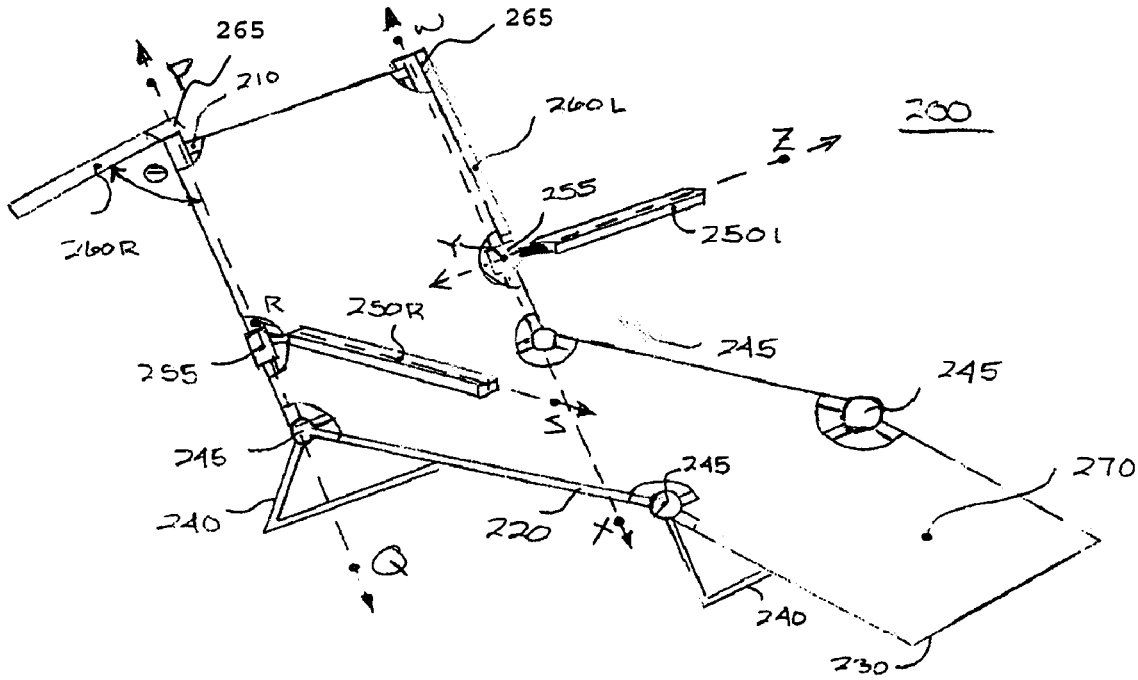
FIG. 4 is a perspective diagram illustrating a lounge chair according to some embodiments of the invention.

FIG. 4 is a perspective diagram illustrating a first position of an exemplary lounge chair according to some embodiments of the invention.

Referring to FIG. 4, a lounge chair 200 according to some embodiments of the invention includes an adjustable back support 210, a seat support 220, an adjustable foot/leg support 230, two legs 240, and four pivots 245. In the illustrated embodiments, the back support 210, the seat support 220, the foot/leg support 230, and legs 240 have a tubular metal construction.

The lounge chair 200 also includes a first set of armrests 250 that consist of a left armrest 250L and a right armrest 250R, two securement devices 255 that attach the left armrest 250L and the right armrest 250R to the back support 210, and a second set of armrests 260 that consist of a left armrest 260L and a right armrest 260R.

As shown in FIG. 4, canvas 270 is attached between the back support 210, seat support 220, and foot/leg support 230, providing a region where a person using the lounge chair 200 may be supported. Before the lounge chair 200 is assembled the canvas 270 is fitted to the back support 210, seat support 220, and foot/leg support 230. This may be easily accomplished by folding the outer edges of the canvas back onto itself and stitching a seam to hold the canvas together. This creates a sleeve that slides over the tubular metal frame that forms the back support 210, the seat support 220, and foot/leg support 230.

It should be apparent that other materials besides canvas may be used, depending on the design of the lounge chair. For example, the material attached between the back support 210, the seat support 220, and the foot/leg support 230 may consist of many individual bands of plastic tubing, canvas, or other fabric. The individual bands of material may be attached to opposing sides of the back support 210, the seat support 220, and the foot/leg support 230. The bands that are aligned in one direction may be interwoven with the bands of material that are aligned in a second direction to create a lightweight, strong support for persons using the lounge chair 200. The first and second directions may be perpendicular to each other, but they do not have to be.

Alternatively, if a lounge chair having very firm support is required, a wooden lounge chair may have wooden slats attached vertically or horizontally between the back support 210, seat support 220, or foot/leg support 230. Alternatively, lounge chairs according to embodiments of the invention may also be made of moldable plastic or, for additional reinforcement, plastic laminated with fiberglass.

As is well known in the art, the position of the adjustable back support 210 and the adjustable foot/leg support 230 with respect to the seat support 220 may be varied by operation of the pivots 245, which attach the back support 210 and the foot/leg support 230 to the seat support 220. The legs 240 are pivotably attached at either end to the seat support 220, allowing the legs 240 to be folded flat against the seat support 220 when the lounge chair 200 is not in use.

There are many different conventional ways in which the legs 240, the seat support 220, the back support 110, and the foot/leg support 230 may be attached to each other, and there are many different conventional shapes and designs that exist for legs, seat supports, back supports, and foot/leg supports. Likewise, besides pivots 245, there are many alternative conventional mechanisms that may be used to vary the angular relationship between seat support 220 and the back support 210, or to vary angular relationship between the seat support 220 and the foot/leg support 230.

A complete description of all such conventional variations and devices is not required, as it will be apparent from the following description that embodiments of the invention may include any conventional furniture configuration where the angular position of the back support 210 relative to the seat support 220 may be adjusted. Thus, the majority of the following detailed description of embodiments of the invention will be devoted to describing the adjustable arm rests 250, 260 and their movement.

As was explained above, the securement devices 255 attach the armrest 250L and 250R to the back support 210. Unlike the conventional securement devices described by Zegeer, the securement devices 255 are maintained in a fixed position on the back support 210. That is, the securement devices 255 do not move along the PQ or the WX line because of the presence of the canvas 270 which is attached to the back support 210 along three sides of the back support.

According to some embodiments of the invention, such as those shown in FIG. 4, the position of the securement device 255 with respect to the PQ and WX lines may be permanently affixed. According to other embodiments of the invention, the position of the securement devices 255 along the PQ and WX line may be adjustable between the limits imposed by the canvas 270 or other supporting material. Either way, embodiments of the invention allow supporting material, such as canvas 270, to be attached to the upright portions of the back support 210 as well as the horizontal portions of the back support. This is an advantage over the conventional chaise lounge described above because more effective support can be provided to the person who is using the lounge chair.

The securement devices 255, whether fixed with respect to the PQ and WX lines or adjustable with respect to the PQ and WX lines, allow movement of the armrests 250 in at least two angular directions, θ and Φ.

Referring to FIG. 4, for the armrest 250R an angle Φ may be defined as the angle between the vertical plane that contains the PQ line and the line RS that runs longitudinally through the armrest 250R. Similarly, for the armrest 250L, an angle Φ may be defined as the angle between the vertical plane that contains the WX line and the line YZ that runs longitudinally through the armrest 250L. As illustrated in FIG. 4, the armrest 250R has an angle Φ=0 and the armrest 250L has an angle Φ=90.

For the armrest 250R, an angle θ may be defined as the angle between the PQ line and the RS line. For the armrest 250L, an angle θ may be defined as the angle between the WX line and the YZ line. As illustrated in FIG. 4, the armrest 250R has an angle θ=0 and the armrest 250L has an angle θ=90.

As illustrated in FIG. 4, each of the armrests 250 is independently adjustable. Furthermore, it should be recognized that the armrests 250 and securement devices 255 may be configured to allow for any particular θ, Φ adjustment limited only by the armrest 250 impinging onto other structures of the lounge chair 200.

In preferred embodiments of the invention, the armrests 250 are configured to be adjusted by a person using the lounge chair through the simple method of pushing and pulling on the particular armrest to achieve the desired position. That is, unlike the conventional chaise lounge described by Zegeer, the securement devices 255 do not require a manual loosening/retightening to adjust the angular (Φ, θ) position of the armrests 250.

According to preferred embodiments of the invention, the force required to push/pull the armrests 250 into a new position is greater than the force exerted by a person resting his or her arm upon one of the armrests 250. In some embodiments of the invention, the securement devices 255 may consist of a ball and socket joint. Other embodiments of the invention may use other types of securement devices 255, besides ball and socket joints, to achieve the same function.

Figure 5:
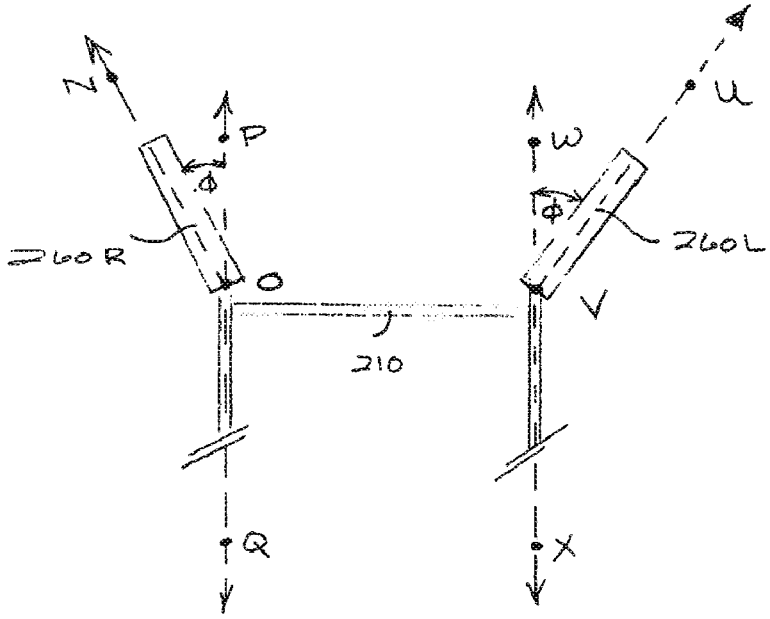
FIG. 5 is a plan diagram further illustrating the lounge chair of FIG. 4.

FIG. 5 is a plan diagram illustrating the back support 210 and the second set of arms 260 in further detail. Other portions of the lounge chair 200 that were illustrated in FIG. 4 are omitted in order not to obscure inventive aspects of embodiments of the invention.

Referring to FIGS. 4 and 5, preferred embodiments of the invention have a second set of armrests 260, consisting of a right armrest 260R and a left armrest 260L. Typically, a person using the lounge chair 200 will only require the second set of armrests 260 when the lounge chair 200 is in a fully or partially reclined position. The second set of armrests 260 provides a place where the person using the lounge chair 200 may position and comfortably support her arms above her head. This situation may occur not only when the dorsal part of the body is facing upward but also when the ventral part of the body is facing upward.

The armrests 260 are also configured to move in at least two angular directions.

FIG. 4 illustrates the motion of the armrests 260 in the θ direction, where θ is defined as the angle that the armrests 260R, 260L make with the PQ and WX lines, respectively. As illustrated in FIG. 4, the armrest 260L lies flush with the back support 210 (θ=0), while the armrest 260R has been moved to a position that is approximately normal (θ=90) to the PQ line. Typically, a person using the lounge chair 200 and the second armrests 260 will be most comfortable when the angle θ between the armrests 260 and their respective lines PQ, WX is about 180 degrees. In other words, referring to FIG. 5, a person using the lounge chair 200 and the second armrests 260 will be most comfortable when the plane containing the lines PQ and WX is approximately the same as a plane containing the lines NO, UV, where the lines NO, UV pass longitudinally through the armrests 260.

FIG. 5 illustrates the motion of the armrests 260 in the Φ direction, where Φ is defined as the angle that the armrests 260R, 260L make with the vertical planes that contain the lines PQ and WX, respectively. The vertical plane that contains the line PQ and the vertical plane that contains the line WX are each normal to the plane that contains both the line PQ and the line WX. As shown in FIG. 5, both of the armrests 260 are skewed outwardly from the vertical planes containing the PQ and WX lines.

As illustrated in FIG. 5, each of the armrests 260 is independently adjustable. Furthermore, it should be recognized that the armrests 260 may be configured to allow for any particular θ, Φ adjustment limited only by the armrest 260 impinging onto other structures of the lounge chair 200.

In preferred embodiments of the invention, the armrests 260 are configured to be adjusted by a person using the lounge chair through the simple method of pushing and pulling on the particular armrest to achieve the desired position.

According to preferred embodiments of the invention, the force required to push or pull the armrests 260 into a new position is greater than the force exerted by a person resting his or her arm upon one of the armrests 260. In some embodiments of the invention, the mechanism 265 that allows for the θ, Φ movement of the armrests 260 may consist of a ball and socket joint. Other embodiments of the invention may use other types of conventional mechanisms besides ball and socket joints to achieve the same function.

In the embodiments illustrated in FIGS. 4 and 5, there is no movement of the armrests 260 along the lines PQ and WX. However, in alternative embodiments of the invention there may be adjustable repositioning of the armrests in this direction as well. For example, referring to FIGS. 4 and 5, telescoping metal rods may be placed inside the upright supports of the back support 210 so that they are aligned with the lines PQ and WX. The armrests 260 may then be attached to the end of the telescoping metal rods with ball and socket joints. Thus, the armrests 260 may be repositioned further away from the chair, by moving the telescoping metal rods outwardly along the lines PQ and WX.

According to some embodiments of the invention, there may be drink or beverage holders incorporated into the second set of armrests 260, which would allow persons laying belly-down on the lounge chair 200 to conveniently access beverage cans and bottles and prevent the beverage cans and bottles from being spilled and/or stepped on.

Figure 6A:
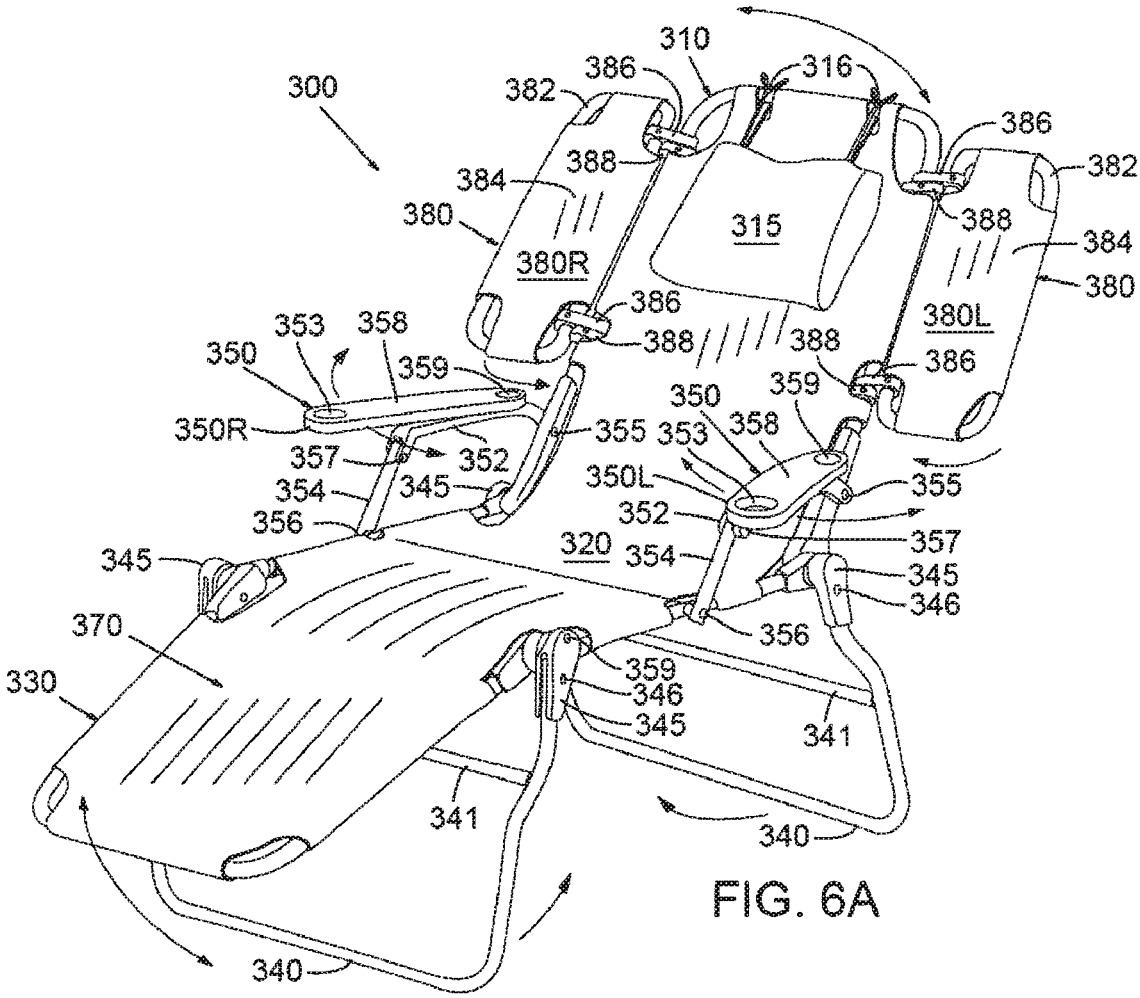
FIG. 6A is a perspective view of an exemplary lounge chair according to some embodiments of the invention.
Figures 6B, 6C:
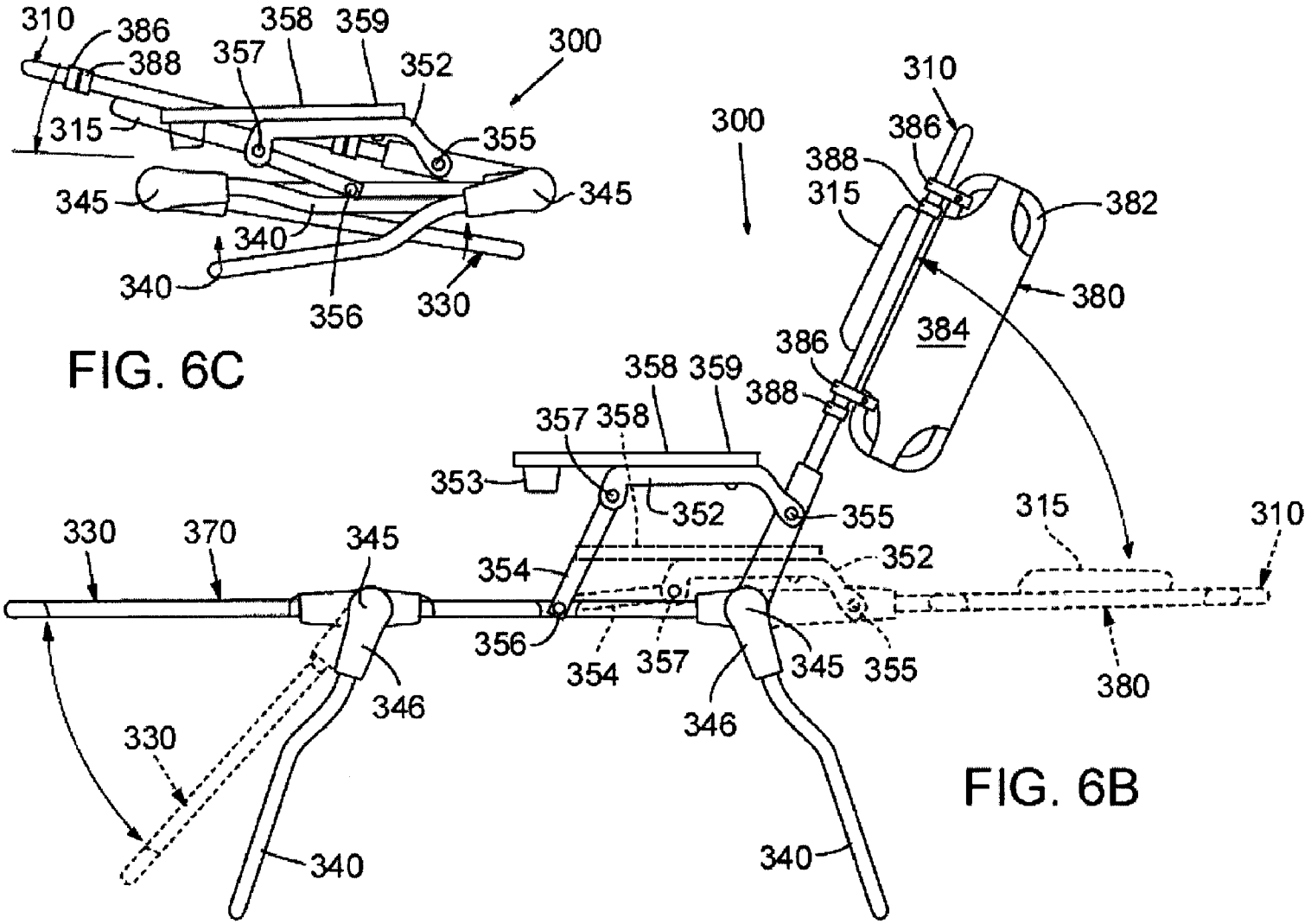
FIG. 6B is a side view of a lounge chair according to some embodiments of the invention.
FIG. 6C is a side view of a folded lounge chair according to some embodiments of the invention.

FIG. 6A is a perspective view of an exemplary lounge chair according to some embodiments of the invention. FIG. 6B is a side view of a lounge chair according to some embodiments of the invention. FIG. 6C is a side view of a folded lounge chair according to some embodiments of the invention.

Referring to FIGS. 6A through 6C, a lounge chair 300 according to some embodiments of the invention includes an adjustable back support 310, a seat support 320, an adjustable foot/leg support 330, two legs 340, four pivots 345, and a support member 370. The lounge chair 300 also includes a set of armrests 350 including right armrest 350R and left armrest 350L. Each of the armrests 350R and 350L includes a first rotary joint 355, an armrest base 352, an armrest support 354, a second rotary joint 356, a rest 358, a pivot joint 357, and a third rotary joint 359.

The first rotary joint 355 rotatably connects the armrest base 352 to the back support 310. The first rotary joint 355 enables the armrest base 352 to rotate with respect to the back support 310 when the position of the back support 310 is adjusted relative to the seat support 320. The second rotary joint 356 rotatably connects the armrest support 354 to the seat support 320. The pivot joint 357 connects the armrest support 354 to the armrest base 352 and allows the armrest support 354 and the armrest base 352 to pivot with respect to each other. The second rotary joint 356 and the pivot joint 357 enable the armrest base 352 to rotate with respect to the seat support 320 when the position of the back support 310 is adjusted relative to the seat support 320. In other words, as the back support 310 is adjusted relative to the seat support 320, the first rotary joint 355, second rotary joint 356, and pivot joint 357 allow the armrest base 352 to maintain a substantially horizontal position, as shown in FIG. 6B.

FIG. 6B shows an armrest 350 in a first position (solid lines) and a second position (dotted lines). The first position corresponds to the back support 310 being in an upright position, for instance, when a person is sitting upright in the lounge chair 300. The second position corresponds to the back support 310 being in a substantially horizontal position, for instance, when a person is lying down in the lounge chair 300. It should be noted that in both of the first and second positions, the armrest 350 maintains a substantially horizontal position. This is accomplished by the first and second rotary joints, 355 and 356, and the pivot joint 357. Specifically, as the back support 310 rotates about the pivots 345: the armrest base 352 rotates with respect to the back support 310 at the first rotary joint 355; the armrest support 354 rotates with respect to the seat support 320 at the second rotary joint 356; and the armrest base 352 rotates with respect to the armrest support at the pivot joint 357. Thus, the rest 358 is maintained in a substantially horizontal position despite the change in the position of the back support 310.

The pivot joint 357 and the second rotary joint 356 can include pivot pins. A first one of the pivot pins can penetrate the armrest support 354 and the seat support 320 such that the armrest support 354 can rotate with respect to the seat support 320. A second one of the pivot pins can penetrate the armrest base 352 and the armrest support 354 such that the armrest support 354 can rotate with respect to the armrest base 352.

The third rotary joint 359 rotatably connects the rest 358 to the armrest base 352. The third rotary joint 359 allows the rest 358 to rotate with respect to the armrest base 352 so that the rest 358 can be positioned inwards (i.e., across the lap of a person sitting in the chair) or outwards (away from the person). The rest 358 can include a holder 353, which can be use to hold small items, sunglasses, beverages, and the like. A person of ordinary skill in the art will recognize that when a beverage is held in the holder 353, the back support 310 can be adjusted with respect to the seat support 320 without the beverage spilling because the rest 358 is maintained in a substantially horizontal position. The third rotary joint 359 can be any type of joint that will allow movement of the rest 358 with respect to the armrest base 352. Further, the third rotary joint 359 can be a freely moveable or configured to be rigidly or semi-rigidly held in various positions.

The back support 310 can also include a head rest 315. The head rest 315 can be removably attached to the back support 310 by the attachments 316. The attachments 316 can be, for example, strings that can be tied around the upper portion of the back support 310. The head rest 315 can be attached to the back support 310 so as to allow the head rest 315 to rotate from a front side of the back support 310 (i.e., to be used as a pillow by a person sitting in the chair) to a back side of the back support 310.

The pivots 345 rotatably connect the legs 340 at both ends of the seat support 320. The pivots 345 also connect the seat support 320 to each of the back support 310 and the foot/leg support 330. The pivots 345 can include locks 346 that are used to lock the legs 340 into place. The locks 346 can prevent the legs 340 from moving undesirably while a person is arranging themselves in the chair. The legs 340 can also include support beams 341 to provide additional mechanical stability to the legs 340.

According to some embodiments of the invention, the lounge chair 300 includes a set of platforms 380 including a right platform 380R and a left platform 380L. Each of the right platform 380R and the left platform 380L includes a platform frame 382, a platform support member 384, and at least one chair attachment 386. The at least one chair attachment may correspond to a platform attachment 388 on the back support 310 of the lounge chair 300. The platforms 380 can be rotatably attached to the back support 310 such that the platforms can be rotated so as to be substantially in the plane of the back support 310 during use and rotated behind the back support 310 when not in use. A person of ordinary skill in the art will appreciate that other orientations of the platforms 380 with respect to the back support 310 are also possible.

Referring to FIG. 6C, when the lounge chair 300 is not in use, the chair can be folded into a compact form for storage.

Figure 7A:
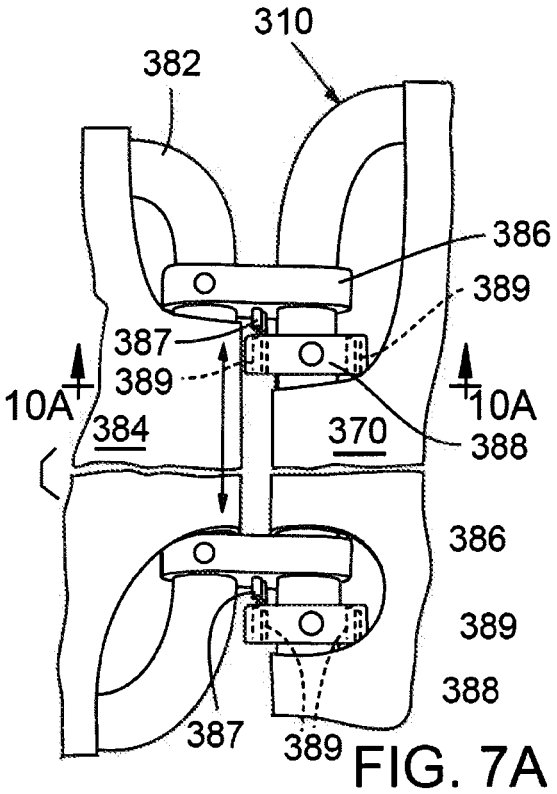
FIGS. 7A and 7B are diagrams illustrating a chair attachment according to some embodiments of the present invention.
Figure 7B:
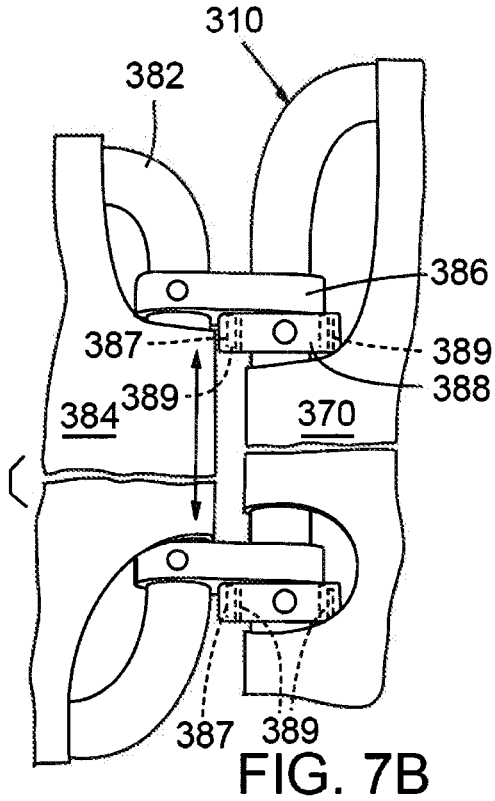

FIGS. 7A and 7B are diagrams illustrating a chair attachment according to some embodiments of the present invention.

Referring to FIGS. 7A and 7B, the chair attachment 386 is disposed on the platform frame 382. A platform attachment 388 corresponding to the chair attachment 386 can be disposed on the back support 310 of the lounge chair 300. The chair attachment 386 can include one or more pins 387 and the platform attachment 388 can include holes 389 corresponding to the pins 387. The pins 387 can engage with the holes 389 to secure the platform 380 into position. For example, when a person desires to use the platforms 380, the person can rotate the platforms 380 from behind the back support 310 until the platforms 380 are substantially parallel with the back support 310. Then, the person can engage the pins 387 into the holes 389 to lock the platforms 380 into place. In this way, the platforms 380 can support the arms of a person lying in the lounge chair 300. When a person is not using the platforms 380, the person can rotate the platforms 380 behind the back support 310 and lock the platforms 380 into place. A person of ordinary skill in the art will appreciate that multiple pins 387 can be provided in each chair attachment 386 so that the platforms 380 can be secured in several different positions.

Although described above as having pins to lock the platforms 380 into position, a person of ordinary skill in the art will recognize that other types of chair attachment locking mechanisms are possible. For example, a complementary toothed pivot can be used such that the platforms 380 can be rigidly held in multiple different positions.

Figure 8A:
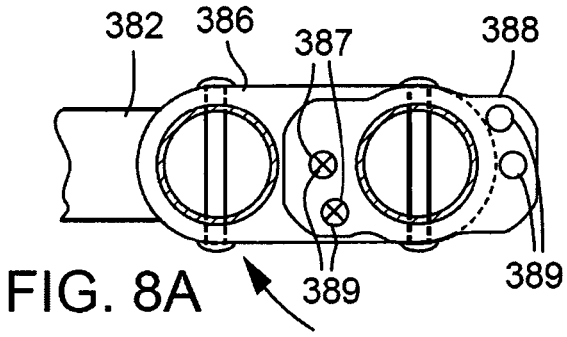
FIGS. 8A through 8C are diagrams illustrating various positions of a chair attachment according to some embodiments of the invention.
Figure 8B:
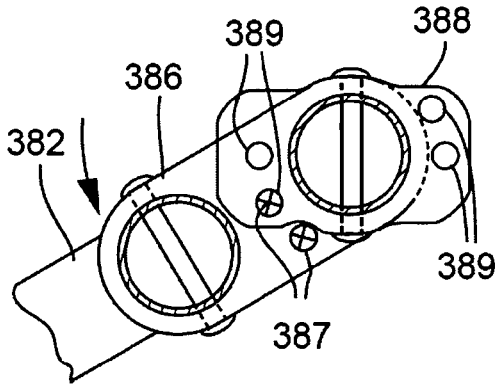
Figure 8C:
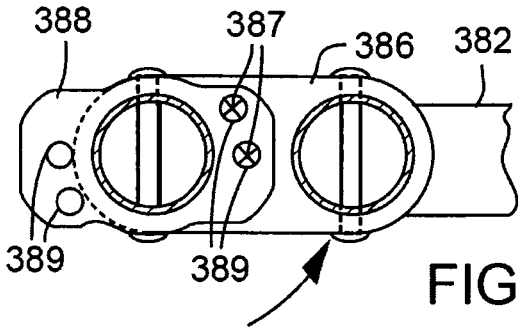

FIGS. 8A through 8C are diagrams illustrating various positions of a chair attachment according to some embodiments of the invention.

In FIG. 8A, a platform 380 is shown in a first position. In the first position, two pins 387 are engaged in two holes 389 such that the platform is rigidly held in position. In FIG. 8B, the platform 380 is shown in a second position. In the second position, the platform 380 has been rotated counter-clockwise with respect to the first position and now one pin 387 is engaged with one hole 389. In FIG. 8C, the platform 380 is shown in a third position. In the third position, the platform 380 has been rotated approximately 180 degrees from the first position. Now, the two pins 387 are engaged with two different holes 389, rigidly holding the platform in the third position. Although only shown in three positions, a person of ordinary skill in the art will appreciate that many more positions are possible depending on the positions of the pins 387 and the holes 389.

According to the embodiments of the invention described above, the convenience of lounge, pool, and patio furniture is increased by providing adjustable armrests that do not require cumbersome adjustments in order to reposition the armrest. According to some embodiments of the invention, an additional pair of armrests may be attached to existing conventional chair designs that have only one pair of armrests in order to increase the utility of the chair, which may be especially useful for lounge chairs, patio furniture, chaise lounges, and the like.

Embodiments of the invention may be practiced in many ways. What follows are exemplary, non-limiting descriptions of some embodiments of the invention.

According to some embodiments of the invention, a chair includes a seat support, a back support attached to the seat support by a linkage, the linkage configured to adjust an angle between the back support and the seat support, the back support having a right side and a left side, a first armrest attached to the right side of the back support by a first device, and a second armrest attached to the right side of the back support by a second device.

According to some embodiments, the first device is structured to provide angular movement of the first armrest around a first axis and a second axis, the first axis perpendicular to the second axis.

According to some embodiments, the second device is structured to provide angular movement of the second armrest around a third axis and a fourth axis, the third axis perpendicular to the fourth axis.

According to some embodiments, the second device includes a ball and socket joint.

According to some embodiments, the second device is structured to provide linear movement of the second armrest along a fifth axis.

According to some embodiments, the second device includes a telescoping part that fits inside the right side of the back support.

According to some embodiments, the chair also includes a third armrest attached to the left side of the back support by a third device, and a fourth armrest attached to the left side of the back support by a fourth device.

According to other embodiments of the invention, a folding lounge chair includes a first armrest, a second armrest, a third armrest, and a fourth armrest.

According to some embodiments, the folding lounge chair includes a frame, the first, second, third, and fourth armrests rotationally affixed to the frame by a first mounting bracket, a second mounting bracket, a third mounting bracket, and a fourth mounting bracket, respectively.

According to some embodiments, each of the first, second, third, and fourth mounting brackets is configured to rotate the first, second, third, and fourth armrests, respectively, about at least two rotational axes.

According to some embodiments, the first mounting bracket is configured to linearly displace the first armrest along a first axis and the second mounting bracket is configured to linearly displace the second armrest along a second axis.

According to some embodiments, the third mounting bracket is configured to linearly displace the third armrest along a third axis and the fourth mounting bracket is configured to linearly displace the fourth armrest along a fourth axis.

According to some embodiments, the first, second, third, and fourth mounting brackets include ball and socket joints.

According to some embodiments, the frame is chosen from the group consisting of wood, metal, and moldable plastic.

According to still other embodiments of the invention, a system includes an armrest and a mounting bracket structured to attach the armrest to a chair with at least two existing armrests.

According to some embodiments, the mounting bracket is structured to provide rotational movement of the armrest around at least two rotational axes.

According to some embodiments, the mounting bracket includes a ball and socket joint.

According to some embodiments, the mounting bracket is structured to provide linear movement of the armrest along a first axis.

According to some embodiments, the mounting bracket includes a telescoping mechanism.

According to some embodiments, the armrest includes a beverage holder.

The preceding embodiments are exemplary. Although the specification may refer to "an", "alternative", or "some" embodiment(s) in several locations, this does not necessarily mean that each such reference is to the same embodiment(s), or that the feature only applies to a single embodiment.

One of ordinary skill in the art will recognize that the concepts taught herein can be tailored to a particular application in many other advantageous ways. Many of the specific features shown herein are design choices. Such minor modifications are encompassed within the embodiments of the invention, and are intended to fall within the scope of the appended claims. In particular, those skilled in the art will recognize that the illustrated embodiments are but one of many alternative implementations that will become apparent upon reading this disclosure.

I claim:

1. A chair, comprising:

a seat support;

a back support attached to the seat support by one or more first pivots, the first pivots configured to adjust an angle between the back support and the seat support;

a first armrest and a second armrest, each of the first and second armrests attached to the back support;

a leg support attached to the seat support by one or more second pivots, the second pivots configured to adjust an angle between the leg support and the seat support; and a first platform and a second platform, the first and second platforms rotatably attached to the back support, wherein each of the first and second platforms attaches to a respective side of the back support at two or more points along the back support and wherein the first and second platforms are configured to rotate behind the back support and lock into a fixed position behind the back support.

2. The chair of claim 1, wherein each of the first and second platforms includes:

a platform frame;

a platform support member disposed on the platform frame; and at least one chair attachment rotatably attaching the platform frame to the back support.

3. The chair of claim 2, further comprising at least one platform attachment disposed on the back support and configured to engage with the at least one chair attachment.

4. The chair of claim 3, further comprising:

one or more pins disposed in the at least one chair attachment; and one or more holes disposed in the at least one platform attachment, the one or more holes configured to engage with at least one of the one or more pins.

5. The chair of claim 1, further comprising a pair of legs rotatably attached to first and second ends of the seat support by the first and second pivots.

6. The chair of claim 5, further comprising locks on the first and second pivots, the locks configured to lock the legs into at least one fixed position with respect to the seat support.

7. The chair of claim 5, wherein each of the legs includes at least one support beam.

8. The chair of claim 1, further comprising a headrest removably attached to the back support.

9. The chair of claim 1, wherein each of the first and second armrests is configured to remain in a substantially horizontal position as the angle between the back support and the seat support is adjusted.

10. A chair, comprising:

a seat support;

a back support attached to the seat support by one or more first pivots, the first pivots configured to adjust an angle between the back support and the seat support;

a first armrest and a second armrest, each of the first and second armrests attached to the back support by a first rotary joint and attached to the seat support by a second rotary joint, wherein each of the first and second armrests includes:

an armrest base rotatably attached to the back support by the first rotary joint;

an armrest support rotatably attached to the seat support by the second rotary joint;

a pivot joint rotatably connecting the armrest base to the armrest support; and a rest rotatably attached to the armrest base by a third rotary joint;

a leg support attached to the seat support by one or more second pivots, the second pivots configured to adjust an angle between the leg support and the seat support;

a first platform and a second platform, the first and second platforms rotatably attached to the back support, wherein each of the first and second platforms includes:

a platform frame;

a platform support member disposed on the platform frame; and one or more chair attachments rotatably attaching the platform frame to the back support;

a pin disposed in at least one of the chair attachments and configured to engage with at least one hole in a platform attachment disposed on the back support; and a pair of legs rotatably attached to first and second ends of the seat support by the first and second pivots.

11. A chair, comprising:

a seat support;

a back support attached to the seat support by one or more first pivots, the first pivots configured to adjust an angle between the back support and the seat support;

a first armrest and a second armrest, each of the first and second armrests attached to the back support by a first rotary joint and attached to the seat support by a second rotary joint;

a leg support attached to the seat support by one or more second pivots, the second pivots configured to adjust an angle between the leg support and the seat support;

a first platform and a second platform, the first and second platforms rotatably attached to the back support, wherein each of the first and second platforms includes:

a platform frame;

a platform support member disposed on the platform frame; and one or more chair attachments rotatably attaching the platform frame to the back support;

a pin disposed in at least one of the chair attachments and configured to engage with at least one hole in a platform attachment disposed on the back support; and a pair of legs rotatably attached to first and second ends of the seat support by the first and second pivots.

12. The chair of claim 11, further comprising locks on the first and second pivots, the locks configured to lock the legs into at least one fixed position with respect to the seat support.

13. The chair of claim 11, wherein each of the legs includes at least one support beam.

14. The chair of claim 11, further comprising a headrest removably attached to the back support.

15. The chair of claim 11, wherein each of the first and second armrests is configured to remain in a substantially horizontal position as the angle between the back support and the seat support is adjusted.

16. The chair of claim 11, wherein the first and second platforms are configured to rotate behind the back support and lock into a fixed position such that the first and second platforms are disposed behind the back support.

* * * * *

UNITED STATES PATENT AND TRADEMARK OFFICE

CERTIFICATE OF CORRECTION

PATENT NO. : 7,832,804 B2
APPLICATION NO. : 12/105084
DATED : November 16, 2010
INVENTOR(S) : Sandi LaFreniere It is certified that error appears in the above-identified patent and that said Letters Patent is hereby corrected as shown below:

Column 3, line 10, the word "10R" should read -- 110R --;
Column 3, line 11, the word "10L" should read -- 110L --.

Signed and Sealed this
Twenty-fifth Day of January, 2011

David J. Kappos

David J. Kappos
*Director of the United States Patent and Trademark Office*